US005515838A

United States Patent [19]

Anderson

[11] Patent Number: 5,515,838

[45] Date of Patent: May 14, 1996

[54] PAINT BALL GUN

[75] Inventor: Donald L. Anderson, Racine, Wis.

[73] Assignee: Donald R. Mainland, Racine, Wis.

[21] Appl. No.: 217,439

[22] Filed: Mar. 24, 1994

[51] Int. Cl.[6] ..... F41B 11/32

[52] U.S. Cl. ..... 124/76; 124/73

[58] Field of Search ..... 124/56, 31, 37, 124/70, 71, 72, 73, 74, 76

[56] References Cited

U.S. PATENT DOCUMENTS

| | | | |
|---|---|---|---|
| Re. 27,568 | 1/1973 | Vadas et al. | 124/74 X |
| 2,554,116 | 5/1951 | Monner | 124/76 X |
| 2,640,476 | 6/1953 | Spink | 124/50 X |
| 2,817,328 | 12/1957 | Gale . | |
| 2,818,056 | 12/1957 | Martin | 124/72 |
| 2,940,438 | 6/1960 | Merz | 124/74 X |
| 3,204,625 | 9/1965 | Shepherd | 124/50 X |
| 3,494,344 | 2/1970 | Vadas et al. | 124/74 |
| 3,547,095 | 12/1970 | Vadas et al. | 124/74 X |
| 3,572,310 | 3/1971 | Chiba | 124/74 X |
| 3,612,026 | 10/1971 | Vadas et al. | 124/76 |
| 3,788,298 | 1/1974 | Hale | 124/76 |
| 4,004,566 | 1/1977 | Fischer | 124/59 |
| 4,116,193 | 9/1978 | Chiba | 124/72 |
| 4,304,213 | 12/1981 | Jereckos | 124/69 |
| 4,616,622 | 10/1986 | Milliman | 124/73 |
| 4,819,609 | 4/1989 | Tippmann | 124/72 |
| 4,850,330 | 7/1989 | Nagayoshi | 124/76 |
| 4,910,903 | 3/1990 | Senfter | 42/69.02 |
| 4,936,282 | 6/1990 | Dobbins et al. | 124/74 |
| 5,063,905 | 11/1991 | Farrell | 124/72 |
| 5,097,816 | 3/1992 | Miller | 124/49 |
| 5,161,516 | 11/1992 | Ekstrom | 124/73 |
| 5,257,614 | 11/1993 | Sullivan | 124/73 |
| 5,349,938 | 9/1994 | Farrell | 124/73 |
| 5,349,939 | 9/1994 | Perrone | 124/76 |

*Primary Examiner*—Eric K. Nicholson
*Assistant Examiner*—John A. Ricci
*Attorney, Agent, or Firm*—Nilles & Nilles

[57] ABSTRACT

Disclosed is a paint ball gun having a passage for porting pressurized gas to a ball projectile, a primary gas chamber, and a primary valve for controllably flowing pressurized gas from the primary chamber to the passage. The improved gun has a secondary gas chamber, an aperture connecting the passage and the secondary chamber and a spool-type secondary valve closing the aperture when the primary valve is in the intermediate position. The secondary chamber and secondary valve prevent pressurized gas from flowing into the hammer chamber (for re-cocking) until the ball is well on its way out of the barrel. Higher, more consistent ball velocity results. The new gun, of modular construction, also has a novel arrangement for controlling release of the hammer and "catching" such hammer as it is driven into its re-cocked position.

19 Claims, 7 Drawing Sheets

FIG. 5
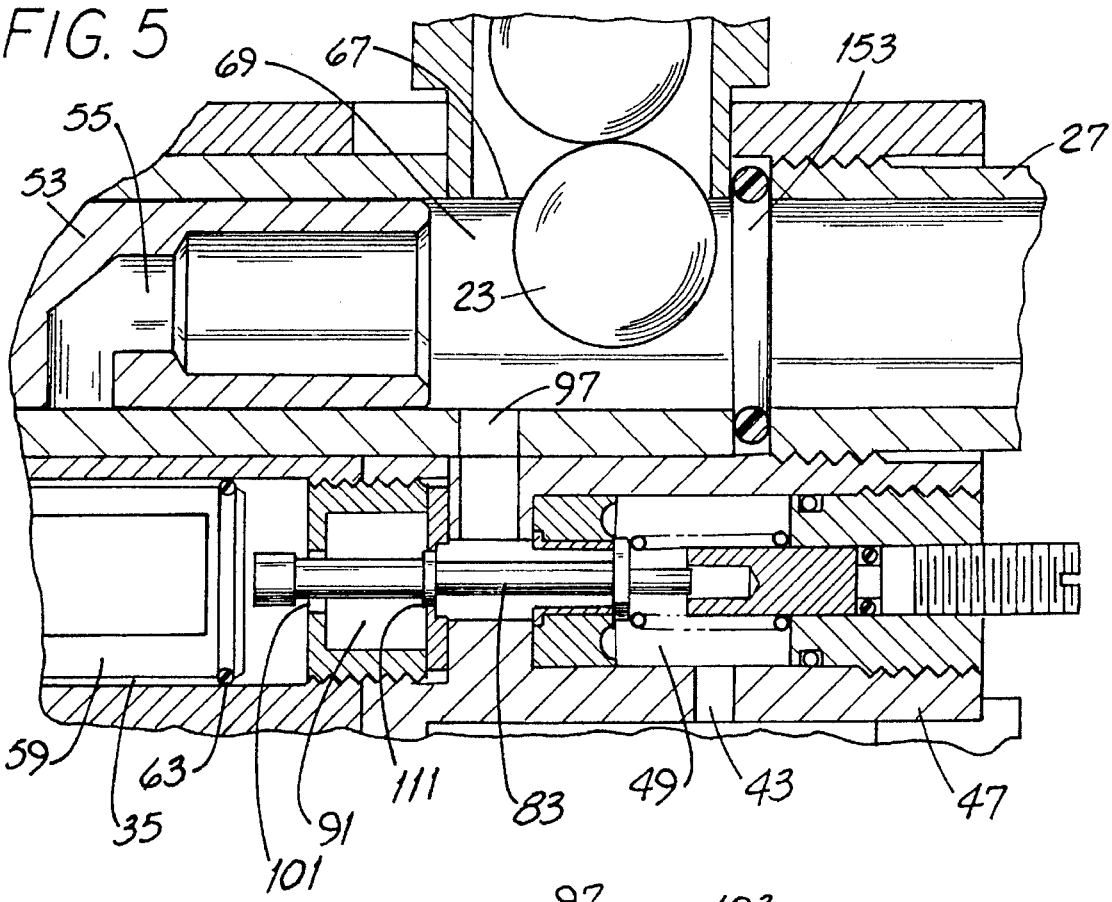
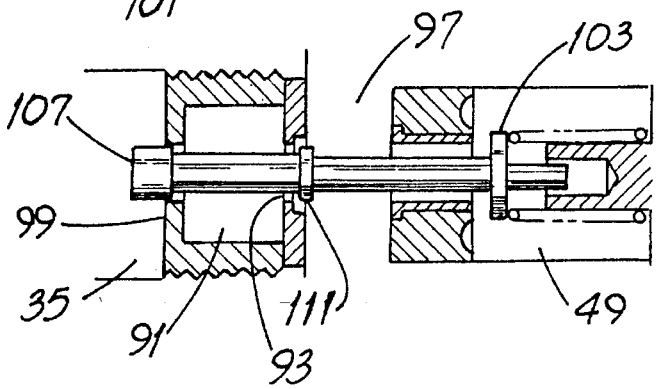
FIG. 8
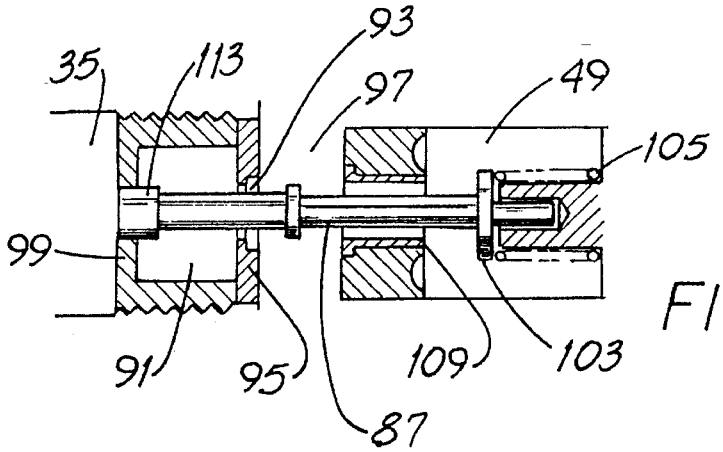
FIG. 9

FIG. 11
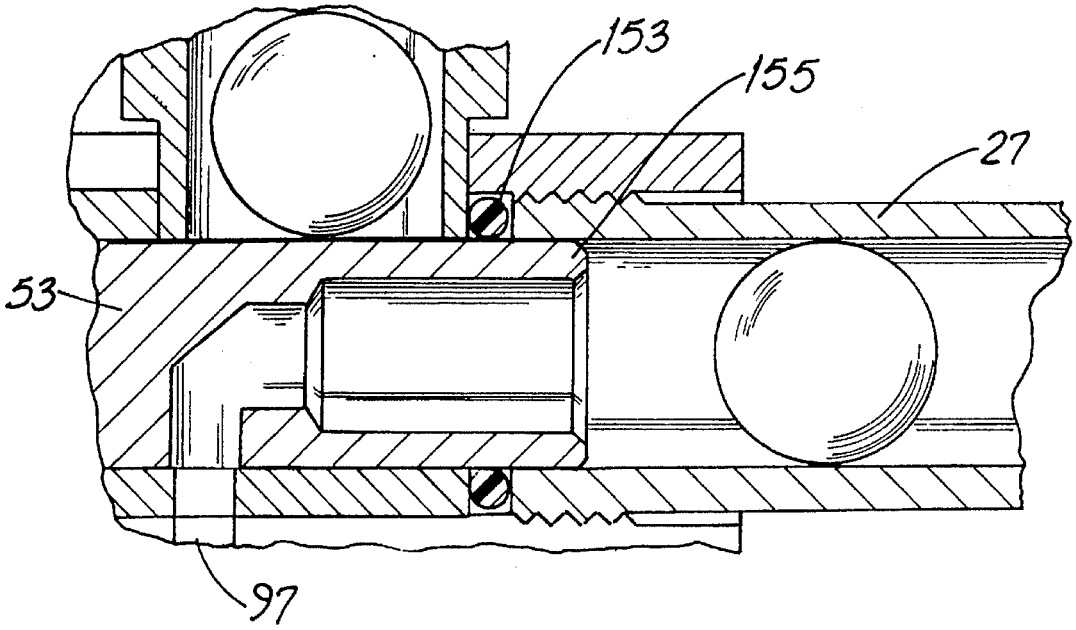
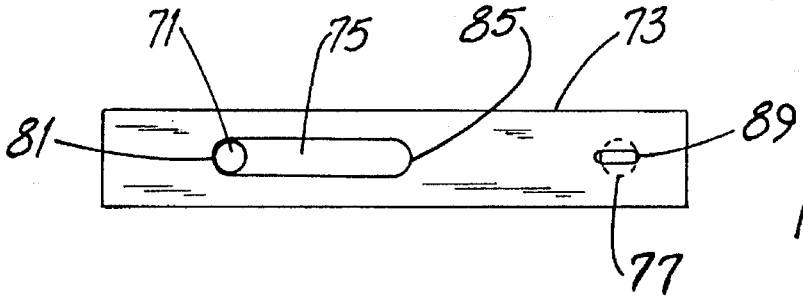
FIG. 6
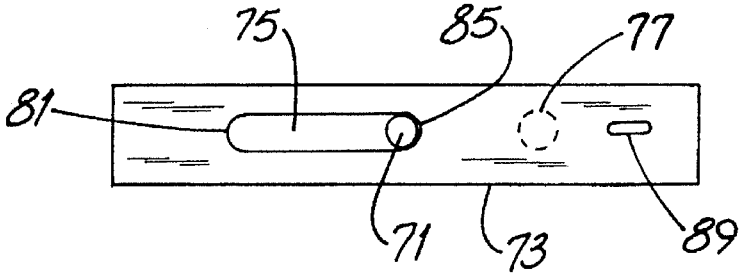
FIG. 7

PAINT BALL GUN

FIELD OF THE INVENTION

This invention relates generally to firearms and, more particularly, to gun-like apparatus using pressurized gas (rather than gunpowder) to propel a projectile.

BACKGROUND OF THE INVENTION

For decades if not centuries, firearms have been used for sporting and military purposes. And using firearms for shooting at stationary and moving targets for entertainment or contest purposes has become increasingly popular. Often, firearm training for military purposes is carried out using mock combat situations and arms loaded with blank ammunition. Similarly, some types of contests, e.g., "quick-draw" contests, can be conducted using blank ammunition and electronic timers.

However, using firearms loaded with blank ammunition lacks realism at least because there is no good way to ascertain whether the "shooter" has hit a target.

A rather recent innovation involves firearm-like "guns" which use compressed gas to discharge a projectile such as a small (typically 0.68 inches diameter) paint ball. The ball, being frangible, ruptures upon impact and it is very visibly apparent as to whether and where a "shot" has hit its mark. Earlier uses of such guns involved tree marking in forestry projects and animal marking in conservation or farming projects.

People were quick to realize how such guns could advantageously be used in target shooting and military training involving "war game" or "stalking" contests. And such guns were also quickly adopted for contests not involving military training.

When such pneumatic guns are used in games involving human participants "shooting" at one another, such participants wear protective clothing and face shields. Each participant carries a gun connected to a cylinder of pressurized gas, e.g., carbon dioxide, by a flexible tube. The cylinder is carried on one's back out of the way. The gun has a magazine containing one hundred or more paint balls which are (typically) gravity-fed into discharge position in the gun. Assuming sufficient gas pressure is available and that the gun is functioning properly, a ball is discharged with each squeeze of the trigger.

Pneumatic guns for discharging projectiles such as paint balls are shown in U.S. Pat. Nos. 3,788,298 (Hale); 4,936,282 (Dobbins et al.) and 5,161,516 (Ekstrom). Pneumatic guns for discharging other types of projectiles, e.g., pellets or BBs, are shown in U.S. Pat. Nos. 2,554,116 (Monner); 2,640,476 (Spink) and 3,612,026 (Vadas et al.) and 4,616,622 (Milliman).

While prior art guns of the foregoing types have been generally satisfactory for their intended purpose, some are attended by disadvantages. For example, one such gun uses a single valve to direct pressurized gas from the primary gas chamber to both the projectile and the chamber in which the hammer moves. Gas to the hammer chamber is used to drive the hammer rearward, re-cocking the gun.

Variances in friction between the hammer and its chamber wall, whether caused by wear, dirt or the like, affect the magnitude and duration of hammer pressurization required to fully cock it. If friction is low, the hammer moves quickly and smoothly and the relevant volume of gas in the hammer chamber expands rapidly. Such rapid expansion may detract from the pressure used to discharge the projectile and projectile velocity is reduced.

On the other hand, if friction is higher, the hammer may move more slowly, the volume of gas in the hammer chamber expands slowly and the primary valve is retained open for a longer period of time. As a consequence, substantially full input pressure continues to be applied to the projectile, notwithstanding that it is well down the barrel. This increases projectile velocity.

Either type of event affects the "dynamics" of projectile discharge. Projectile velocity may not be the same from shot to shot. As a result, the gun may require a different aiming point for each shot—this is a very annoying problem for the user.

Another problem relating to pneumatic guns is that of very rapid (but unwanted) cycling or "motorboating," so named because the sound of the gun rapidly cycling resembles that of a motor boat. Such rapid cycling usually occurs when the pressurized gas cylinder is close to being depleted and its pressure low. And it occurs in guns of the type having a single valve simultaneously porting gas to both the projectile and to the hammer chamber. Under circumstances of low gas pressure, the hammer does not re-cock, the gun is unable to discharge a projectile and, sometimes, the bolt fractures a ball which has not yet had time to roll into alignment with the barrel.

When rapid cycling, a gun emits a characteristic, very audible sound. Such sound immediately informs others that the user of such gun is unable to fire and, thus, is more susceptible to "attack."

Yet another disadvantage of certain prior art pneumatic guns is that when a ball-type projectile is fed from a magazine into alignment with the barrel, such projectile may if slightly undersized roll part way down the barrel rather than being retained at the barrel breach. In consequence, a greater volume of gas at a particular pressure is required to discharge the projectile. And because the projectile is "under pressure" for a shorter period of time, it may not attain proper velocity upon discharge.

Yet another disadvantage of certain prior art pneumatic guns is that they cannot be "taken down" or partially disassembled and re-assembled quickly and with minimal or no tools. It is not too uncommon for a paint ball to jam in the gun or for other types of malfunctions to occur. Sometimes such malfunctions result from dirt in the gun or a fractured paint ball. The gun user should be able to quickly disassemble the gun to the degree necessary to clear the cause of the malfunction and, just as quickly, be able to re-assemble it ready to use.

An improved paint ball gun which addresses the foregoing disadvantages would be an important advance in the art.

OBJECTS OF THE INVENTION

It is an object of the invention to provide a new pneumatically powered gun overcoming some of the problems and shortcomings of the prior art.

Another object of the invention is to provide a pneumatically powered gun which provides more consistent discharged projectile velocity.

Another object of the invention is to provide a pneumatically powered gun which substantially avoids rapid cycling.

Yet another object of the invention is to provide a pneumatically powered gun having a generally consistent aiming point for a particular distance from gun to target.

Another object of the invention is to provide a pneumatically powered gun which restrains the projectile at the barrel breach.

Still another object of the invention is to provide a pneumatically powered gun which may be very quickly disassembled and re-assembled.

How these and other objects are accomplished will become more apparent from the following descriptions and from the drawing.

SUMMARY OF THE INVENTION

Certain aspects of the invention (which are disclosed in connection with a paint ball gun) relate to a unique gas chamber and valving arrangement. Other aspects relate to an improved trigger arrangement and sear control mechanism which helps prevent "phantom" automatic cycling of the gun. And the gun incorporates modular construction permitting very rapid disassembly and re-assembly. Each of these aspects is discussed in the order mentioned above.

As to the gas chamber and valving arrangement, the invention involves a gun-like apparatus for pneumatically discharging a projectile such as a paint ball. Such apparatus includes (a) a propulsion passage for porting pressurized gas to the projectile, (b) a primary gas chamber, and (c) a primary valve movable between a fully closed position, an intermediate position and an open position. Such valve flows pressurized gas from the primary chamber to the propulsion passage when the primary valve is in the intermediate position.

In the improvement, the apparatus has a secondary gas chamber and a gas flow aperture connecting the passage and the secondary chamber. Such apparatus also has a secondary valve which closes the aperture when the primary valve is in the intermediate position. In a highly preferred embodiment, the primary valve and the secondary valve move in unison.

In another aspect of the invention, the aperture between the primary gas flow passage and the secondary chamber is open when the primary valve is in the closed position. This permits pressurized gas in the secondary chamber to re-cock the hammer while at the same time preventing such gas from leaking back into the propulsion passage.

The primary valve is also movable between its intermediate position and a "full open" position, the latter occurring upon discharge of the projectile. The passage/chamber aperture is also open when the primary valve is in such open position.

The hammer of the apparatus is confined in a hammer chamber and there is a hole connecting the secondary gas chamber and the hammer chamber. A hammer valve is spaced from the hole when the primary valve is in the closed position so that the secondary gas chamber and the hammer chamber are then in flow communication. On the other hand, the hammer valve closes the hole when the primary valve is in the intermediate position and when such primary valve is in the open position. In a highly preferred embodiment, the hammer valve moves in unison with the primary and secondary valves.

The new trigger arrangement and sear control mechanism will now be summarized. The apparatus also has (a) a hammer, (b) a sear for releasably restraining the hammer, and (c) a trigger for pivoting the sear to release the hammer. Such sear pivots between a first hammer-restraining position and a second position.

A new sear control mechanism is interposed between the trigger and the sear and such mechanism has a first component releasably engaging a second component. The first component disengages from the second component when the sear is in the second position. In the disclosed arrangement, the first component is an elongate latch bar, the second component is a tube-like sleeve and the sear has a tang engaging an opening in the sleeve.

When the gun is ready to discharge a projectile and the trigger is being squeezed, the latch bar is engaged with the sleeve and the sear tang is in the sleeve opening. With continued trigger squeezing, the bar urges the sleeve in the forward direction along a linear path against the force of a biasing spring. In so doing (and by virtue of the tang/sleeve engagement), the sear is pivoted until the hammer is released to open the primary valve and pneumatically discharge the projectile.

A camming surface on the released hammer continues to pivot the sear toward and to a second sear position. At such position, the sear contacts the latch bar and disengages it from the sleeve. The sleeve, then no longer being held by the latch bar, moves in the rearward direction under the urging of its spring. Such sleeve has an opening in it for receiving the latch bar when the latch bar is disengaged from the sleeve.

To put it another way, the latch bar and the sleeve may be said to be "end-to-end" preparatory to projectile discharge. After the hammer is released and the latch bar disengaged from the sleeve, the bar and sleeve are in overlapping relationship.

Specifically, the bar is within the opening in the sleeve and while the hammer is automatically re-cocked and held by the sear, the next projectile cannot be discharged until finger pressure on the trigger is relaxed and the trigger is permitted to return to its repose position. Such trigger arrangement helps prevent full automatic projectile discharge.

The gun has a path for feeding a projectile into alignment with the gun barrel. In yet another aspect of the invention, the gun includes a restraining device such as a resilient O-ring or the like interposed between the path and the barrel. The inside diameter of the 0-ring is slightly less than that of the ball and as a projectile is fed along the path and into alignment with the barrel, such ball contacts the O-ring and is restrained in position there for pneumatic discharge.

The new gun also has a feature which helps prevent "motorboating." Such sound, audible and annoying, alerts an "enemy" stalker that the gun is unable to fire.

And modular construction makes the gun extremely easy to disassemble. The gun has a block and a receiver piece retained in position in the block by first and second attachment devices such as a locking pin and a knurled knob, respectively. Such device are removable from the gun and when removed, the receiver piece may be withdrawn from the block.

More specifically, the gun also has a housing retained in abutment with the block by the first and second attachment devices. The housing may also be detached from the block when the attachment devices are removed.

Other details of the invention are set forth in the following detailed description and in the drawing.

BRIEF DESCRIPTION OF THE DRAWING

FIG. 5 is an enlarged view of the the hammer, bolt and gas valving arrangement of the new gun. Parts are broken away. The new valving device is shown with the primary valve in closed position.

FIG. 6 is a view of the slide, cocking lever, hammer chamber vent port and slide slot as the hammer approaches the cocked position. Parts are shown in dashed outline.

FIG. 7 is a view of the slide, cocking lever, hammer chamber vent port and slide slot as the hammer approaches the projectile-discharge position. Parts are shown in dashed outline.

FIG. 8 is a view generally like that of FIG. 5 and showing the valving device with the primary valve in an intermediate position.

FIG. 9 is a view generally like that of FIG. 5 and showing the valving device with the primary valve in a fully open position.

FIG. 11 is a view showing the bolt in its final "projectile-discharge" position after the trigger is squeezed and before the gun is re-cocked.

DETAILED DESCRIPTION OF PREFERRED EMBODIMENTS

Figure 1:
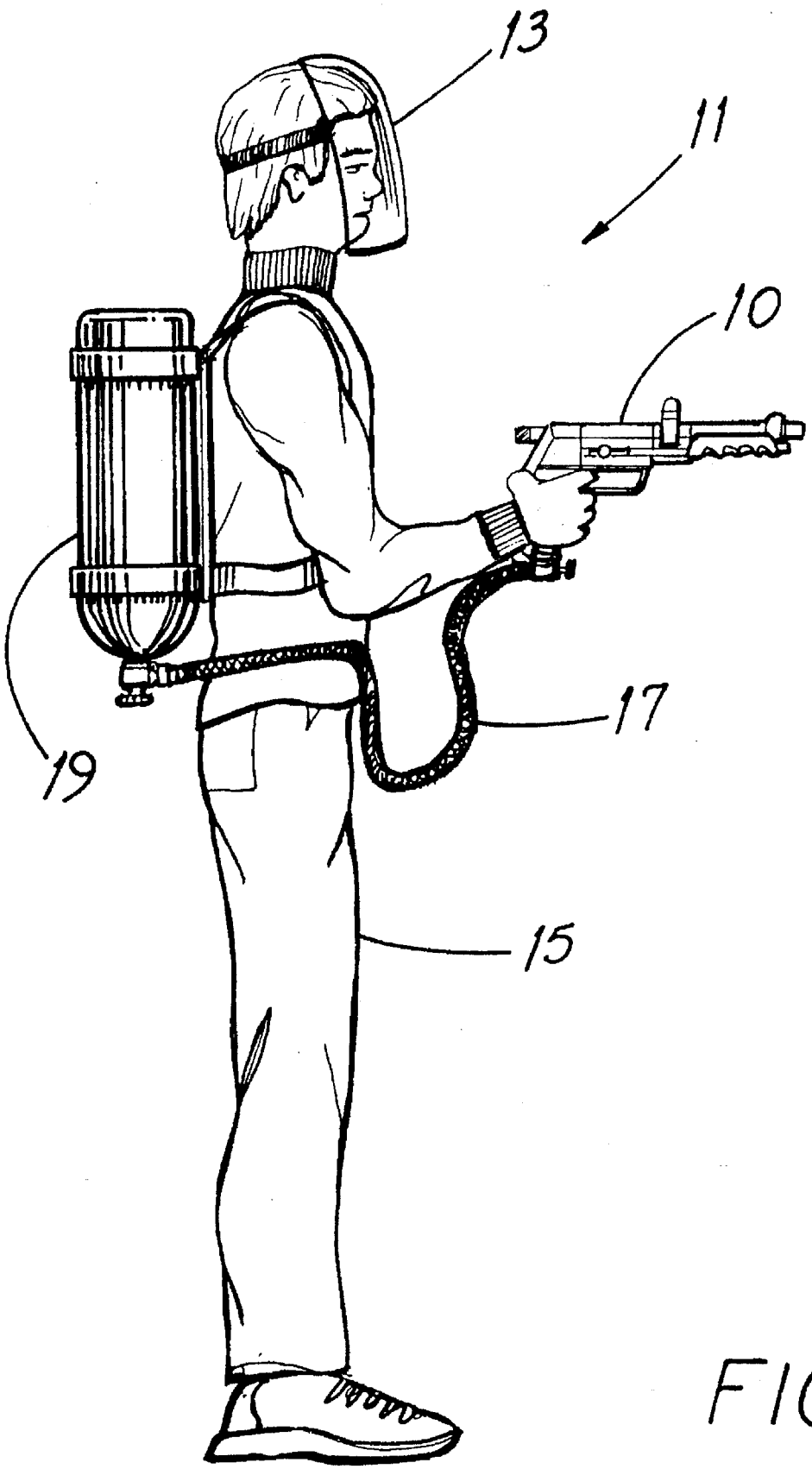
FIG. 1 is a simplified view of a person using the inventive gun.
Figure 2:
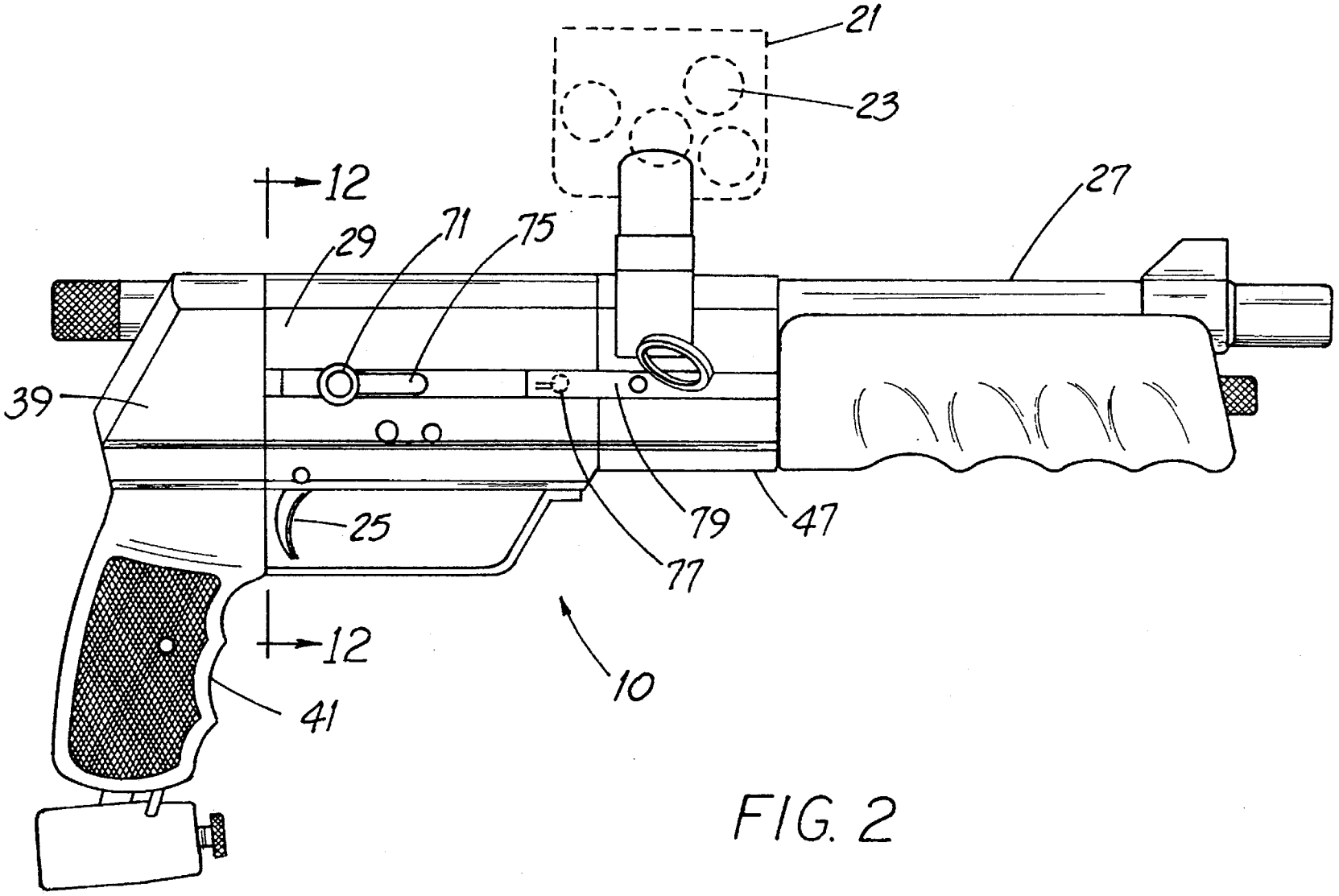
FIG. 2 is a right-side elevation view of the gun.

Understanding of the new gun 10 will be aided by the following brief description of one way it is used. Referring to FIGS. 1 and 2, a user 11 of the gun 10 is (or should be) equipped with a face shield 13 and protective clothing 15. The gun 10, hand-held in the illustration, is connected by a flexible tube 17 to a cylinder 19 of compressed gas. The gun 10 is usually equipped with a magazine 21 holding a number of projectiles such as paint balls 23 and each time the trigger 25 is squeezed, a projectile 23 is discharged from the barrel 27.

Figure 3:
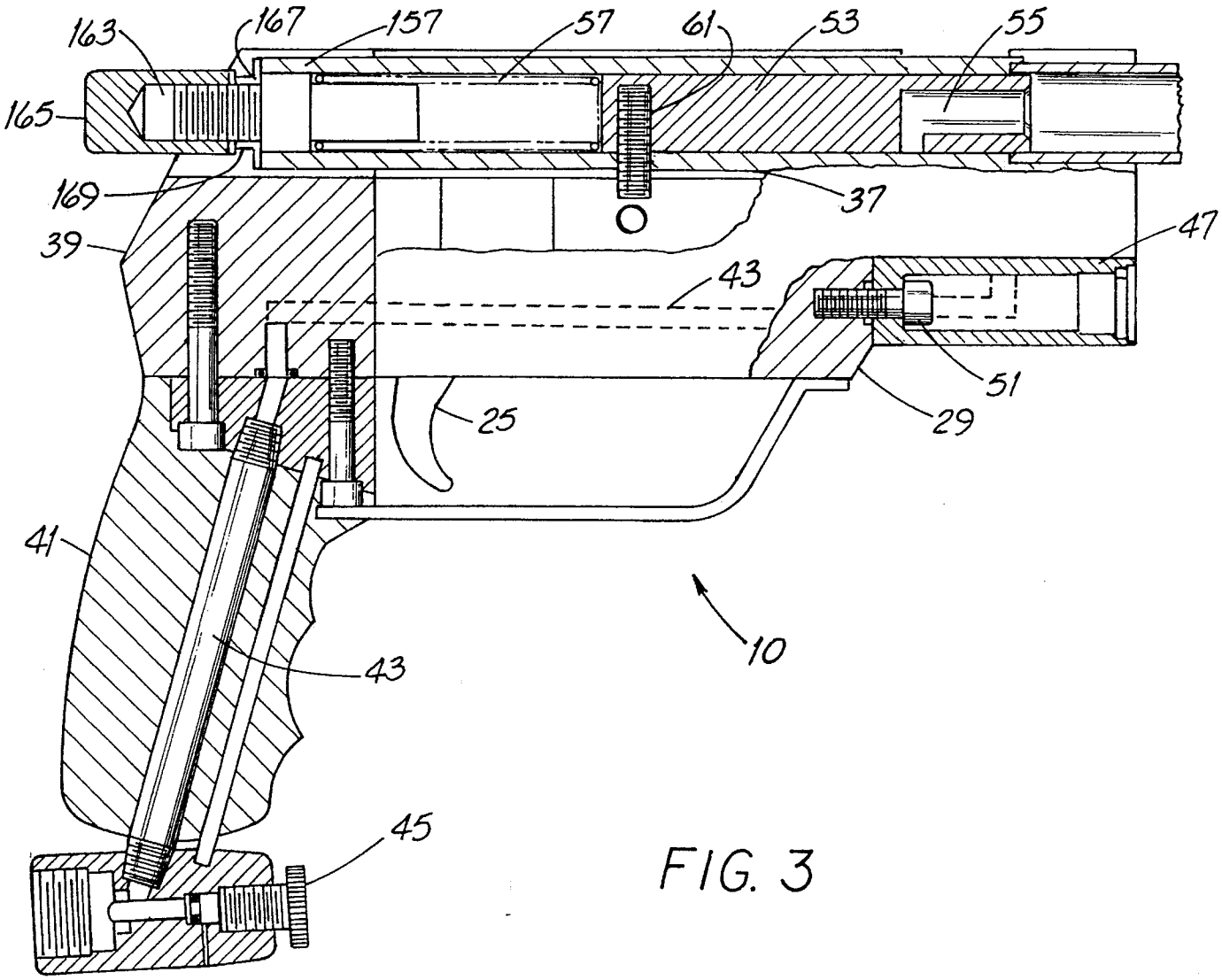
FIG. 3 is a representative section view of the gun showing certain gun components. Parts are broken away.

In this specification, terms such as "forward," "rearward," "rear" and the like are as referred to the gun 10 depicted in FIGS. 2 and 3. Rearward and forward are to the left and to the right, respectively, in such FIGURES.

Figure 4:
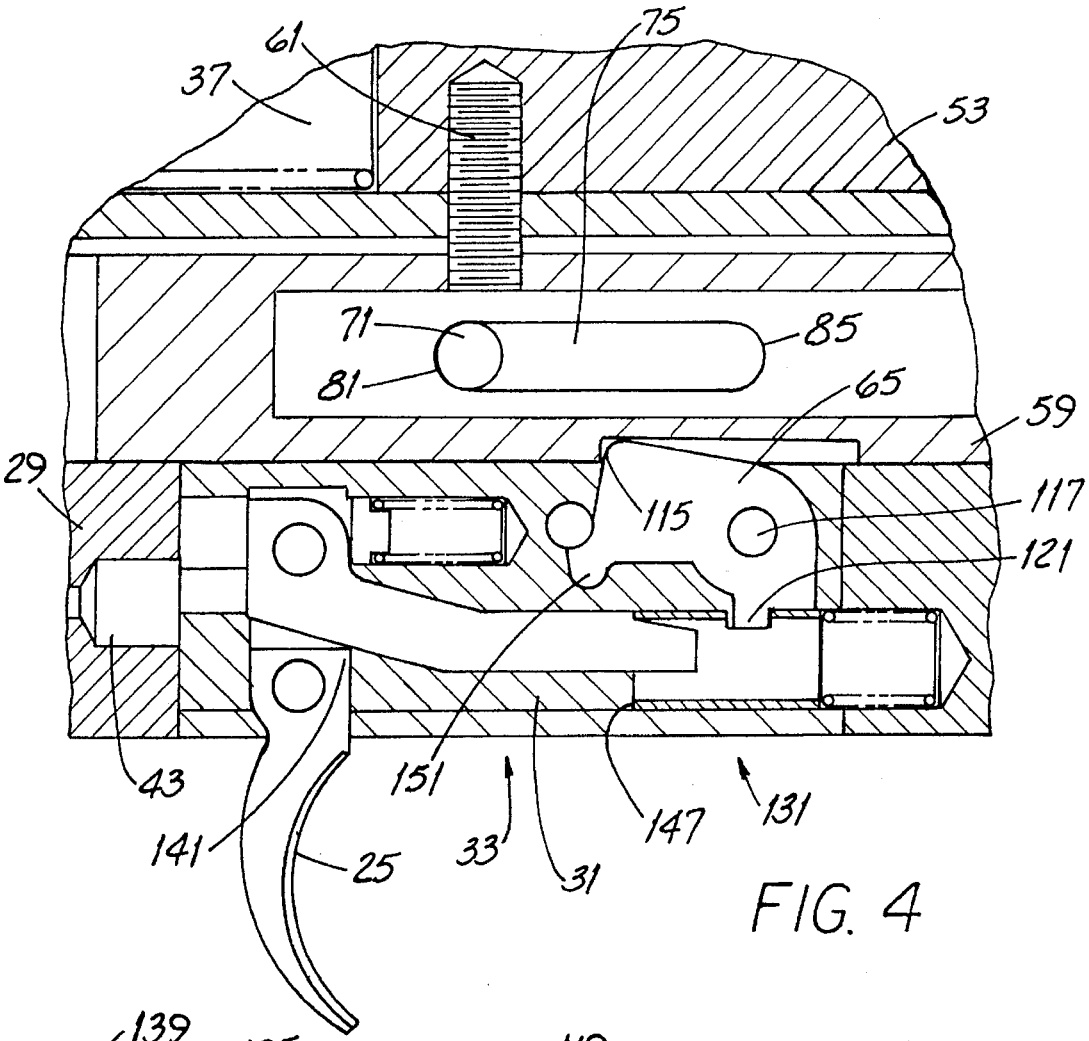
FIG. 4 is an enlarged view of the trigger and sear arrangement of the new gun. Parts are broken away.

The main parts of the gun 10 will now be identified. Referring also to FIGS. 4 and 5, the gun 10 is modular in construction and has a block 29 in which is formed a cavity 31 for the trigger assembly 33, a hammer chamber 35 and an upper bolt chamber 37. The chambers 35, 37 are generally cylindrical and parallel. Attached to the rear of the block 29 is a housing 39 having a handle assembly 41 attached thereto. Pressurized gas from the cylinder 19 is introduced into a flow path 43 through a handadjusted valve 45 at the bottom of the handle assembly 41.

A valve assembly 47 is attached to the front of the block and is in flow communication with the primary gas chamber 49 through an enlarged gas cavity (not shown). Attachment of the assembly 47 to the block 29 is by a screw 51 extending through the rear portion of the assembly 47 and into the block 29.

The upper bolt chamber 37 has a bolt 53 which reciprocates once for each "shot." Such bolt 53 has a generally L-shaped path 55 through which compressed gas flows from the primary chamber 49 to the rear of the projectile 23 to urge the projectile 23 out of the barrel 27. The bolt 53 is biased to the forward or projectile-discharge position by a compression spring 57.

A hammer 59 is free to move in the hammer chamber 35 with slight clearance and is coupled to the bolt 53 by a connecting pin 61. A seal 63 at the forward end of the hammer 59 prevents undue "blowby" of gas past the front face of such hammer 59. Because they are attached together, the bolt 53 and hammer 59 move in unison and, indirectly, the hammer 59 is also biased rightward by the spring 57.

Referring particularly to FIGS. 4 and 5, when the bolt 53 and hammer 59 are held rearward by the sear 65 engaging the hammer 59, the space 67 between the magazine 21 and the breach 69 is open and a ball 23 feeds by gravity into the breach 69. As the bolt 53 and hammer 59 move forward, the bolt 53 closes the space 67 and abuts the ball 23 for pneumatic projectile discharge.

The hammer 59 has a laterally-protruding cocking lever 71 attached to it and a plate-like slide 73 has an elongate aperture 75 through which the cocking lever 71 protrudes. The primary function of the slide 73 is to open and close the hammer chamber vent port at proper times with respect to the position of the hammer. (The vent port 77 is shown in FIG. 2 in dashed outline. Such port 77 is preferably obstructed by a small guard plate 79 to prevent gas from being vented toward the user 11 or a bystander.)

It should be noted that as the cocking lever 71 is drawn rearward to cock the gun 10, the lever 71 engages the rear end 81 of such aperture 75 at an intermediate point along the rearward travel of the hammer 59. In fact, such point is very near the position of such hammer 59 when it is cocked. Thereafter, the slide 73 and hammer 59 (as well as the bolt 53) are drawn rearward in unison for a relatively short distance and during such slide/hammer travel, the slide 73 opens the hammer chamber vent port 77. From the foregoing, it should be appreciated that if the hammer 59 does not travel sufficiently far rearward, the vent port 77 is not opened. This fact is of importance when considering the "anti-motorboating" feature described below.

When the trigger 25 is pulled, the hammer 59 moves forward (along with the attached bolt 53) and at an intermediate point along the forward travel of the hammer 59 (in fact at a point very near where the hammer 59 strikes the stem 83), the cocking lever 71 engages the front end 85 of such aperture 75 and the slide 73 is urged forward to close the vent port 77. Closure is just prior to the hammer 59 striking the stem 83 of the valve device 87.

The "timing" with which the slot 89 in the slide 73 opens and closes the hammer chamber vent port 77 is also shown in FIGS. 6 and 7. In FIG. 6, the hammer 59 is cocked and just prior to cocking, the cocking lever 71 has contacted the rear end 81 of the aperture 75 and drawn the slide 73 rearward so that the slot 89 is in registry with the port 77. As shown in FIG. 7, when the hammer 59 is released by squeezing the trigger 25, the lever 71 contacts the forward end 85 of aperture 75 and moves the slide 73 and, particularly, slot 89 out of registry with the port 77 to close such port 77.

Thus, by keeping the vent port 77 open until just prior to hammer/stem impact, the hammer 59 is permitted to attain maximum velocity in the hammer chamber 35. That is, the hammer 59 and the spring 37 need not "work against" progressively-increasing pressure in the chamber 35 as would be the case if the vent port 77 were closed during the entirety of hammer forward travel.

Referring next to FIGS. 5, 8, and 9, the new valve device 87 and chamber 91 arrangement will now be described. The gun 10 has a secondary gas chamber 91 with an aperture 93 in a first wall 95 to connect such chamber 91 in flow communication with the passage 97 and with the primary chamber 49. In a second wall 99, the chamber 91 has a hole 101 in flow communication with the hammer chamber 35. The way in which the new valve arrangement controls flow of pressurized gas through the primary valve 103, the aperture 93 and the hole 101 will now be described.

At the onset, it is important to note that the new valve device 87 is biased closed by a spring 105, is driven open by the hammer 59 impacting the device distal end 107 and is returned to closure by the spring 105 and by differential pressure acting on the primary valve 103. The sequence of operation is as follows.

The spool-like valve device 87 has a primary valve 103 movable between a fully open position (shown in FIG. 9), an intermediate position (shown in FIG. 8) and a closed position shown in FIG. 5. Such device 87 is biased by the spring 105 in a rearward direction so that absent other forces acting on the device 87, the primary valve 103 is closed. When in the closed position, the primary valve 103 seals against a stationary valve seat 109 and pressurized gas in the primary chamber 49 is thereby prevented from flowing to the propulsion passage 97.

From FIG. 5, it is apparent that when the primary valve 103 is in the closed position, the secondary valve 111 is in an edge-to-edge relationship with the perimeter of the aperture 93 and effectively closes such aperture 93. Further, when the primary valve 103 is in such closed position, the hammer valve 113 is spaced from the perimeter of the hole 101 and gas is free to flow between the secondary chamber 91 and the hammer chamber 35.

Considering FIG. 8, when the primary valve 103 is in the intermediate, partially-open position shown (as a result of the device 87 having been struck by the hammer 59), the secondary valve 111 is also partially open. Pressurized gas then in the propulsion passage 97 can also flow into the secondary chamber 91—but cannot flow to the hammer chamber 35 since the hammer valve 113 is now closed.

Considering FIG. 9 next, when the primary valve 103 is in the fully-open position shown, the secondary valve 111 is also fully open. As with the primary valve 103 in the intermediate position, pressurized gas then in the propulsion passage 97 can flow into the secondary chamber 91 but cannot flow to the hammer chamber 35 since the hammer valve 113 is still closed.

From the foregoing, it should be appreciated that as the primary valve 103 starts to open to pneumatically propel the ball 23 from the gun 10, the secondary chamber 91 and the hammer 35 chamber are isolated from the propulsion passage 97 and from the primary chamber 49. This helps assure that the energy then in the gas pressurized in the chamber 49 and passage 97 is used almost entirely to discharge the ball 21. Very little, if any, of such energy is used to drive the hammer 59 rearward for re-cocking.

The depicted sequence, from FIG. 5 through FIG. 8 to FIG. 9, shows the first phase of how the valve device 87 operates when struck by the hammer 59 after the trigger 25 is squeezed. The following describes how the hammer 59 is re-cocked pneumatically and how the new valve device 87 facilitates such re-cocking.

The FIGS. 9, 8, and 5, will now be considered in that order. It is assumed that the ball 23 has been or is being discharged and the valve device 87 starts leftward movement. It should be noted that when doing so, the secondary chamber 91 is at the same relatively high pressure as the primary chamber 49 and the passage 97.

With continued leftward movement of the device 87 from the position shown in FIG. 9 to an intermediate position shown in FIG. 8, the secondary valve 111 starts to close the aperture 93 and the hammer valve 113 moves in a direction to open the hole 101. Thereupon, pressurized gas in the secondary chamber 91 starts to flow through the hole 101 and into the hammer chamber 35, raising the pressure in such chamber 35. When the primary valve 103 is in the full closed position, the aperture 93 is also fully closed and the hammer valve 113 is fully open. And it is to be recalled that until the hammer 59 is well rearward in the chamber 35 (when moving rearward), the vent port 77 is closed by the slide 73.

The increasing pressure in the secondary chamber 91 and, therefore, in the hammer chamber 35 drives the hammer 59 (and bolt 53) to the rear, cocked position. Near the end of rearward travel of the hammer 59, the cocking lever 71 engages the rear end 81 of the aperture 75 and draws the slide 73 rearward to open the vent port 77 and relieve pressure in the hammer chamber 35. The hammer 59 continues to its fully cocked position by inertia.

When the gun 10 is cocked, the device 87 is in the position shown in FIG. 9 ready for the next impact of the hammer 59 upon the device end 107. Thereupon, the above described "cycle" is repeated. The effect of the inventive arrangement is to defer introducing pressurized gas into the hammer chamber 35 for hammer re-cocking until the secondary chamber 91 is pneumatically isolated from the primary chamber 49 and propulsion passage 97.

The new trigger arrangement and sear control mechanism will now be described. Referring again to FIG. 4 and also to FIG. 10, the gun 10 has a pivot-mounted sear 65 for releasably restraining the hammer 59. Specifically, when in the hammer-restraining position, the sear shoulder 115 engages the hammer 59 (as shown in FIG. 4) and holds such hammer 59 rearward when the hammer 59 is cocked ready for firing. The sear 65 pivots about a pin 117 and there is another pin 119 which limits travel of the sear 65 in the clockwise direction. The sear 65 also has a tang 121 and the purpose of such tang 121 is described below.

The trigger of the gun 10 is a first class lever mounted on a pin 123 for pivoting movement. A spring follower 125 "powered" by a compression spring 127 bears on the upper or distal end 129 of the trigger 25 and urges such trigger 25 counterclockwise toward or to the trigger repose position shown in FIG. 4.

Figure 10:
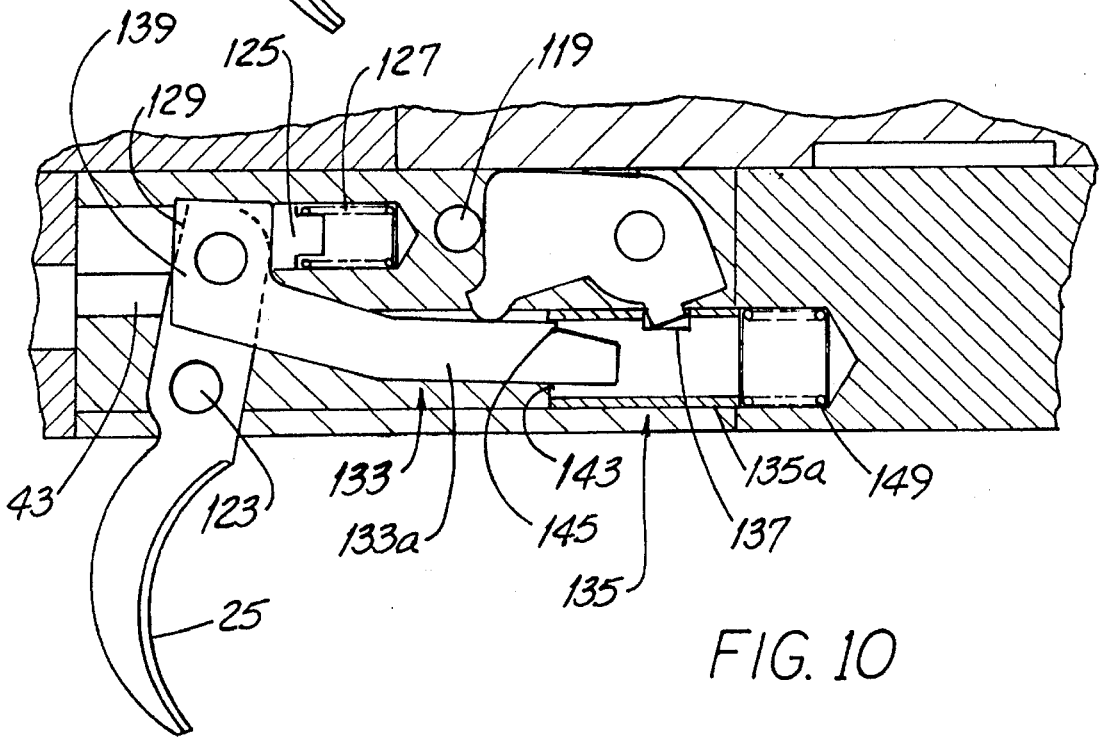
FIG. 10 is a view generally like that of FIG. 4 and showing the trigger and sear control mechanisms in their positions when the trigger has been squeezed and the gun discharged.
Figure 12:
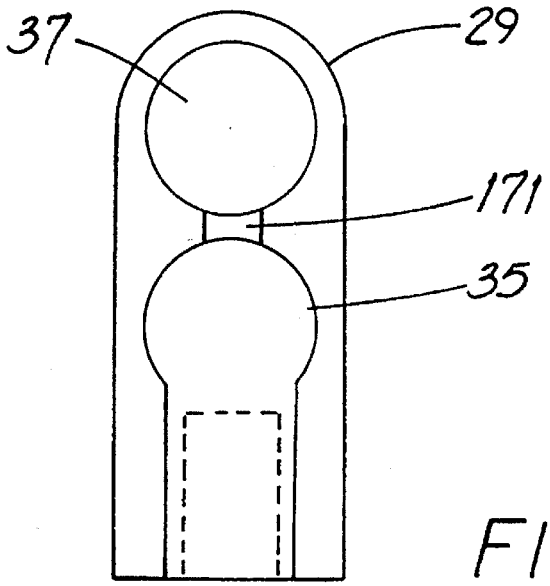
FIG. 12 is an elevation view of the rear surface of the gun block. The view is taken generally along the viewing plane 12—12 of FIG. 2.
Figure 13:
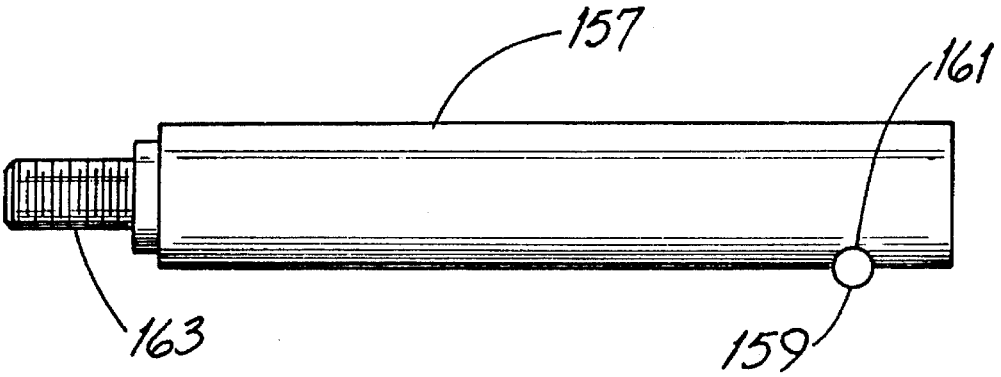
FIG. 13 is a side elevation view of the receiver piece of the gun.

A sear control mechanism 131 is interposed between the trigger 25 and the sear 65 and has a first component 133 releasably engaging a second component 135. The first component 133 disengages from the second component 135 when the sear 65 is in the second or counterclockwise position as shown in FIG. 10. In the depicted arrangement, the first component 133 is an elongate latch bar **133*a*, the second component 135 is a tube-like sleeve 135*a* and the sear tang 121 engages an opening 137 in the sleeve 135*a***.

The following two paragraphs describe movement of the trigger 25 and latch bar **133*a* as finger pressure is released from the trigger 25. The rear or proximal end 139 of the latch bar 133***a* is pivotably pinned to the distal end 129 of the trigger 25 so that as the trigger 25 is urged counterclockwise by the spring 127 to the "ready-to-fire" trigger position (upon release of trigger finger pressure), the latch bar 133*a* is urged leftward. And it is to be noted that as the trigger 25 pivots counterclockwise, its shoulder 141 contacts the bar 133*a* and urges such bar 133*a* counterclockwise.

As the bar 133*a* withdraws sufficiently from the sleeve 143 opening, the bar notch 145 becomes in registry with the left end 147 of the sleeve 135*a*. Thereupon, the bar 133*a* "clicks" into end engagement with the sleeve 135*a* and subsequent forward movement of the latch bar 133*a* also moves the sleeve 135*a* forward. The trigger 25 and sear control mechanism 131 are then positioned to discharge the next ball 23.

When the gun 10 is ready to discharge a projectile 23 and the trigger 25 is being squeezed, the latch bar 133*a* is engaged with the sleeve 135*a* and the sear tang 121 is in the sleeve opening 137. With continued trigger squeezing, the bar 133*a* urges the sleeve 135*a* in the forward direction along a linear path against the force of a biasing spring 149. In so doing (and by virtue of the tang/sleeve engagement), the sear 65 is pivoted until the hammer 59 is released. Near the end of its forward travel, the hammer 59 strikes the end 107 of the device 87 to open the primary valve 103 and pneumatically discharge the projectile 23.

As the hammer 59 travels forward, it urges the sear 65 toward and to a second sear position shown in FIG. 10. At such position, the nose 151 of the sear 65 contacts the latch bar 133*a* and disengages it from the sleeve 135*a*. The sleeve 135*a*, then no longer being held by the latch bar 133*a*, moves in the rearward direction under the urging of its spring 149. Such sleeve 135*a* has the opening 143 in it for receiving the latch bar 133*a* when the latch bar 133*a* is disengaged from the sleeve 135*a*.

To put it another way, the latch bar 133*a* and the sleeve 135*a* may be said to be "end-to-end" preparatory to projectile discharge. After the hammer 59 is released and the latch bar 133*a* disengaged from the sleeve 135*a*, the bar 133*a* and sleeve 135*a* are in overlapping relationship.

Specifically, the bar 133*a* is within the opening 143 in the sleeve 135*a*. Thus, while the hammer 59 is automatically re-cocked and then held by the sear 65, the next projectile 23 cannot be discharged until finger pressure on the trigger 25 is relaxed and the trigger 25 is permitted to return to its repose position.

Referring again to FIG. 5 and also to FIG. 11, the gun 10 has a space 67 though which a projectile 23 is fed into the breach 69 and into alignment with the gun barrel 27. In yet another aspect of the invention, the gun 10 includes a restraining device such as a resilient O-ring 153 or the like interposed between the space 67 and the barrel 27.

The axial position and inside diameter of the O-ring 153 are selected so that as a ball 23 is fed through the space 67 path and into alignment with the barrel 27, such ball 23 contacts the O-ring 153 and is restrained in position there for pneumatic discharge. More particularly, the ball 23 is restrained at a position which prevents the next ball 23 in succession from coming sufficiently in front of the bolt 53 so that such next ball 23 is fractured by the bolt 53 when the gun 10 is discharged.

As shown in FIG. 5, the bolt 53 is spaced from the O-ring 153 when the gun 10 is cocked and ready to be discharged. When the sear 65 releases the hammer 59, the hammer 59 and bolt 53 move forward together. As shown in FIG. 11, at or near the end of the discharge portion of the gun operating cycle, the mouth 155 of the bolt 53 "drives through" the O-ring 153. In so doing, the bolt 53 pushes the ball 23 past such ring 153 and into the barrel 27 at the same time pressurized gas is being applied to the rearward side of the ball 23. A undersized ball 23 is prevented from inadvertently rolling forward into the barrel 27 or even out of the barrel muzzle and ball fracturing is prevented.

Referring now to FIGS. 2, 3, 12 and 13, the modular construction of the gun 10 will now be described. The gun 10 has a hollow, tube-like bolt receiving piece 157 telescopically received in the bolt chamber 37. Such piece 157 is restrained from rearward movement by a first attachment device 159 such as a locking pin 161 engaging a notch in the underside of the piece 157.

At its rear end, the piece 157 has a second attachment device such as an attachment stud 163 and knurled knob 165 threaded to the stud 163. The stud 163 protrudes through a hole 167 in the rear housing 39 and the knob 165 is threaded to the stud 163 and bears against a shoulder 169 on the housing 39. When the knob 165 is tightened, the piece 157 is in tension between the locking pin 159 and the knob 165. And since such piece 157 is restrained in the bolt chamber 37 and cannot move upward as to "ride over" the locking pin 159, the piece 157 is retained in place.

The bolt 53 moves in the receiver piece 157 and there is a slot 171 in the block 29 through which the connecting pin 61 extends. Such slot 171 permits the pin 61 to reciprocate forward and rearward as the gun 10 is being used.

By removing the knurled knob 165 and locking pin 159, the rear housing 39 and handle assembly 41 are released from the block 29. The receiver piece 157, the bolt 53 and the hammer 59 can then be slid rearward and quickly removed from the gun 10 to clear a "jam" or the like. And by removing the screw 51, the valve assembly 47 can be removed for cleaning or repair.

As mentioned above, the new gun 10 has a feature which helps prevent audible "motorboating" or "autocycling" without discharging projectiles 23. It will be recalled from the preceding portion of the specification that if the hammer 59 does not travel rearward a sufficient distance, the vent port 77 is not opened. Insufficient rearward hammer travel usually occurs when the cylinder 19 is nearly depleted of gas and cylinder pressure is low.

If rearward hammer travel is insufficient to cock the hammer 59 (and move the slide 73 and open the vent port 77), the hammer 59 starts forward again since it did not engage the sear 65. However, the hammer chamber 35 is then unvented, the slide 73 not having been brought sufficiently rearward to open the port 77. Therefore, the pressure in the hammer chamber 35 rises as its volume decreases and the velocity of the hammer 59 drops dramatically. In effect, the hammer 59 in its chamber 35 acts like a "deadheaded" piston.

As a result, the hammer 59 either does not strike the end 107 or strikes it with force insufficient to open the primary valve 103. No subsequent hammer movement occurs until a replenished cylinder 19 is attached.

Other aspects of the invention involve a method for preventing autocycling. The gun hammer 59 moves in a chamber 35 between a first or discharge position and a second or cocked position. The method includes the steps of providing a vent port in the chamber 35, e.g., port 77, and opening the port 77 only when the hammer 59 closely approaches the second position. In a more specific aspect, the port opening step is preceded by the step of closing the vent port 77 when the hammer 59 closely approaches the first position. And both the opening step and the closing step include contacting the slide 73 with the cocking lever 71.

While the principles of the invention have been shown in connection with a few specific embodiments, it is to be understood clearly that such embodiments are exemplary and are not limiting.

What is claimed:

1. In a gun for pneumatically discharging a projectile by actuating a hammer valve with a hammer mounted for movement between a forward position and a rearward position, the gun including (a) a passage for porting pressurized gas to the projectile, (b) a primary gas chamber, and (c) a primary valve movable between a closed position and an intermediate position and flowing pressurized gas from the primary chamber to the passage when in the intermediate position, the improvement comprising:

a secondary gas chamber for receiving pressurized gas from the passage;

an aperture connecting the passage and the secondary chamber;

a secondary valve closing the aperture when the primary valve is in the closed position; and the hammer valve being actuated by the hammer moving toward the forward position, such hammer valve porting pressurized gas from the secondary gas chamber to a hammer chamber when the primary valve is in the closed position, such porting of pressurized gas urging the hammer from the forward position toward the rearward position by creating a force acting on the hammer, whereby hammer recocking is delayed until after the projectile is discharged.

2. The gun of claim 1 wherein the primary valve and the hammer valve move in unison.

3. The gun of claim 1 including a barrel and a handle and wherein the barrel is fixed with respect to the handle during projectile discharge.

4. The gun of claim 1 including:

a hole connecting the secondary gas chamber and the hammer chamber for permitting pressurized gas to flow from the secondary gas chamber to the hammer chamber.

5. The gun of claim 4 wherein:

the hammer valve is part of a valve device having a distal end spaced from the hole when the primary valve is in the closed position, whereby the secondary gas chamber and the hammer chamber are then in flow communication.

6. The gun of claim 5 wherein the distal end closes the hole when the primary valve is in the intermediate position.

7. The gun of claim 6 wherein:

the primary valve is movable between the intermediate position and an open position; and the distal end closes the hole when the primary valve is in the open position.

8. The gun of claim 7 wherein the primary valve, the secondary valve and the hammer valve move in unison.

9. The gun of claim 1 including (a) a hammer, (b) a sear for releasably restraining the hammer, and (c) a trigger for pivoting the sear to release the hammer and wherein:

the sear pivots between a first hammer-restraining position and a second position;

the gun includes a sear control mechanism forward of the trigger and interposed between the trigger and the sear;

the control mechanism has a first component releasably engaging a second component;

the first component urges the second component along a linear path when the trigger is squeezed for projectile discharge; and the first component disengages from the second component when the sear is in the second position.

10. The gun of claim 9 wherein when the sear is in the second position, the sear contacts the first component, disengaging the first component from the second component.

11. The gun of claim 10 wherein:

the first component is a latch bar coupled to the trigger; and the second component is a sleeve having an opening therein for receiving the latch bar when the latch bar is disengaged from the sleeve.

12. The gun of claim 1 including a barrel and an angled path for feeding a paint ball from a magazine into alignment with the barrel and wherein:

the gun includes a single restraining device made of compressible material and interposed between the path and the barrel, whereby a paint ball is restrained in position for pneumatic discharge.

13. The gun of claim 1 including:

a handle for holding the gun;

a block fixed with respect to the handle, such block containing the valves and a receiver piece for mounting a bolt; and wherein:

the receiver piece is retained in position in the block by first and second attachment devices removable from the gun, whereby the receiver piece may be withdrawn from the block when the attachment devices are removed.

14. The gun of claim 13 including:

a housing retained in abutment with the block by the first and second attachment devices, and wherein:

the housing may be detached from the block when the attachment devices are removed.

15. A method for preventing autocycling in a gun used to pneumatically discharge a projectile, the gun having a valve and a hammer moving in a chamber between a discharge position for actuating the valve and a cocked position, the chamber containing compressed gas directed thereto by the valve and from a gas flow path in the gun, the method including the steps of:

providing a vent port in the chamber, such vent port being closed for retaining the gas in the chamber as the hammer moves from the discharge position toward the cocked position; and opening the port to vent the gas in the chamber only when the hammer closely approaches the cocked position, whereby, unless the hammer closely approaches the cocked position, compressed gas in the chamber is retained therein and exhibits an increasing force on the hammer to retard hammer velocity if the hammer fails to cock and thereupon moves toward the discharge position, the hammer thereby being decelerated by such force to a velocity at which such hammer is incapable of actuating.

16. The method of claim 15 wherein the port opening step is preceded by the step of closing the vent port when the hammer closely approaches the first position.

17. The method of claim 15 wherein the gun includes a slide actuated by a lever and the opening step includes contacting the slide with the lever.

18. The method of claim 16 wherein the gun includes a slide actuated by a lever and the closing step includes contacting the slide with the lever.

19. The method of claim 15 wherein the first position is a discharge position and the second position is a cocked position.

* * * * *